US008515303B2

(12) United States Patent
Okano et al.

(10) Patent No.: US 8,515,303 B2
(45) Date of Patent: Aug. 20, 2013

(54) LIQUID-COOLING TYPE COOLING DEVICE AND IMAGE FORMING APPARATUS

(75) Inventors: Satoshi Okano, Kanagawa (JP); Tomoyasu Hirasawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 436 days.

(21) Appl. No.: 12/496,961

(22) Filed: Jul. 2, 2009

(65) Prior Publication Data

US 2010/0008694 A1 Jan. 14, 2010

(30) Foreign Application Priority Data

Jul. 10, 2008 (JP) ..... 2008-180078

(51) Int. Cl.
*G03G 21/20* (2006.01)
*G03G 15/00* (2006.01)

(52) U.S. Cl.
USPC ..... 399/94; 399/44

(58) Field of Classification Search
USPC ..... 399/94, 44
See application file for complete search history.

(56) References Cited

U.S. PATENT DOCUMENTS 6,166,907 A * 12/2000 Chien ..... 361/699
2002/0191982 A1* 12/2002 Tsukamoto et al. ..... 399/94

FOREIGN PATENT DOCUMENTS

| | | | |
|---|---|---|---|
| EP | 0 282 353 | A2 | 9/1988 |
| EP | 0 282 353 | A3 | 9/1988 |
| JP | 60-11987 | U | 1/1985 |
| JP | 2005-164927 | | 6/2005 |
| JP | 2005-227610 | | 8/2005 |
| JP | 2007-293111 | | 11/2007 |
| JP | 2008-39288 | | 2/2008 |
| JP | 2008277684 | A * | 11/2008 |

OTHER PUBLICATIONS

U.S. Appl. No. 12/497,182, filed Jul. 2, 2009, Okano, et al.
Office Action issued Oct. 16, 2012 in Japanese Patent Application No. 2008-180078.

* cited by examiner

*Primary Examiner* — David Gray
*Assistant Examiner* — Andrew Do
(74) *Attorney, Agent, or Firm* — Oblon, Spivak, McClelland, Maier & Neustadt, L.L.P.

(57) ABSTRACT

In order to form a circulating route of a liquid cooling medium for cooling a temperature rising part of an image forming apparatus, a liquid-cooling type cooling device includes a heat receiving section which causes the liquid cooling medium to absorb heat of the temperature rising part, a radiator which causes the heat of the liquid cooling medium to release, and a pump which circulates the liquid cooling medium. The heat receiving section includes a heat receiving main body in which a flowing route of the liquid cooling medium and a contacting surface for contacting the temperature rising part are formed, and a heat receiving main body covering part which covers outer surfaces other than the contacting surface of the heat receiving main body. The heat receiving main body covering part is formed of a material whose heat conductivity is lower than that of the heat receiving main body.

9 Claims, 6 Drawing Sheets

LIQUID-COOLING TYPE COOLING DEVICE AND IMAGE FORMING APPARATUS

BACKGROUND OF THE INVENTION

1. Field of the Invention

The present invention generally relates to a liquid-cooling type cooling device which uses circulating liquid and an image forming apparatus using the liquid-cooling type cooling device which prevents temperature inside the image forming apparatus from being increased.

2. Description of the Related Art

Recently, as image forming apparatuses such as a printer, a facsimile machine, and a multifunctional apparatus including a printing function and a facsimile transmitting function, an image forming apparatus using an electrophotographic system or an inkjet system has been well known. Many units and members whose temperature is increased corresponding to operations of the apparatus are disposed in the image forming apparatus using the electrophotographic system or the inkjet system. As the units and the members whose temperature is increased in an image forming apparatus using the electrophotographic system, for example, there are, a reading unit which reads a document by radiating light on the document, a photoconductor body on which an electrostatic latent image is formed by a writing unit, a developing device which forms a visual image by supplying toners onto the electrostatic latent image on the photoconductor body while stirring the toners, the toners which are subjected to friction by the stirring, and a fixing device which fixes the visual image transferred onto a recording medium (paper) by using heat and pressure.

When the temperature rises, some functions do not operate well in the image forming apparatus. Therefore, generally, in order to cool a temperature risen unit or member, a cooling fan is used by air cooling. Hereinafter, in some cases, the units and the members are referred to as temperature rising parts. However, recently, in the image forming apparatus, a heating value has been increased due to high-speed printing, and a heating generation density has been increased due to a small-sized apparatus. Consequently, it has been difficult for the image forming apparatus to sufficiently cool the temperature rising parts by the air cooling.

In order to solve the above problem, cooling devices have been proposed in which cooling efficiency is higher than that of the cooling device by the air cooling. As one of the proposed cooling devices, there is a liquid-cooling type cooling device. In the liquid-cooling type cooling device, a liquid cooling medium is circulated, heat at a temperature rising part is absorbed by the liquid cooling medium at a heat receiving section, and the heat of the liquid cooling medium is radiated at a radiator. In the liquid-cooling type cooling device, the cooling performance is high, and the heat can be absorbed at the heat receiving section in high efficiency. Therefore, the liquid-cooling type cooling device has been proposed to be installed in an image forming apparatus (for example, see Patent Document 1).

However, since water is evaporated from paper inside the image forming apparatus, humidity becomes higher inside the image forming apparatus than that outside the apparatus. In particular, the humidity is likely to become higher in the image forming apparatus using the liquid-cooling type cooling device than an image forming apparatus using an air-cooling type cooling device which ventilates. In the image forming apparatus using the liquid-cooling type cooling device, temperature on outer surfaces of the heat receiving section having high heat receiving efficiency becomes lower than ambient temperature inside the image forming apparatus, and the temperature on the outer surfaces of the heat receiving section becomes a dew point or less. Consequently, there is a risk that dew is condensed on the outer surfaces of the heat receiving section. When the size of a water droplet formed by the dew condensation becomes large and the water droplet drops from the heat receiving section, a part surrounding the heat receiving section is wetted. When the water droplet drops on image forming units or members such as the photoconductor body, the developing device, and the paper; the image quality is degraded due to blurring of the image or the paper may be stained.

In order to prevent the size of the water droplet from being increased when the dew is condensed, a hydrophilic material is applied onto the outer surfaces of the heat receiving section (for example, see Patent Document 2).

[Patent Document 1] Japanese Unexamined Patent Publication No. 2005-164927

[Patent Document 2] Japanese Unexamined Patent Publication No. 2007-293111

In Patent Document 2, the size of the water droplet is prevented from being increased when the dew is condensed; however, the water droplet is not surely prevented from being dropped from the heat receiving section of the liquid-cooling type cooling device.

SUMMARY OF THE INVENTION

In a preferred embodiment of the present invention, there is provided a liquid-cooling type cooling device and an image forming apparatus using the liquid-cooling type cooling device in which a water droplet can be prevented from being dropped from a heat receiving section of the liquid-cooling type cooling device.

Features and advantages of the present invention are set forth in the description that follows, and in part will become apparent from the description and the accompanying drawings, or may be learned by practice of the invention according to the teachings provided in the description. Features and advantages of the present invention will be realized and attained by a liquid-cooling type cooling device and an image forming apparatus using the liquid-cooling type cooling device particularly pointed out in the specification in such full, clear, concise, and exact terms so as to enable a person having ordinary skill in the art to practice the invention.

To achieve one or more of these and other advantages, according to one aspect of the present invention, there is provided a liquid-cooling type cooling device which cools a temperature rising part of an image forming apparatus by forming a circulating route of a liquid cooling medium. The liquid-cooling type cooling device includes a heat receiving section which causes the liquid cooling medium to absorb heat of the temperature rising part, a radiator which causes the heat of the liquid cooling medium to release, and a pump which circulates the liquid cooling medium. The heat receiving section includes a heat receiving main body in which a flowing route of the liquid cooling medium and a contacting surface for contacting the temperature rising part are formed, and a heat receiving main body covering part which covers outer surfaces other than the contacting surface of the heat receiving main body. The heat receiving main body covering part is formed of a material whose heat conductivity is lower than the heat conductivity of the heat receiving main body.

EFFECT OF THE INVENTION

According to an embodiment of the present invention, in a liquid-cooling type cooling device, even if temperature of a heat receiving main body of a heat receiving section having a flowing route of a liquid cooling medium is lower than ambient temperature at a position disposed at the heat receiving section; a heat receiving main body covering part, which covers outer surfaces other than a contacting surface to be contacted a temperature rising part of an image forming apparatus of the heat receiving main body, cover outer surfaces of the heat receiving section, and are formed of a material whose heat conductivity is lower than the heat conductivity of the heat receiving main body. Therefore, the temperature of the heat receiving main body covering part can be maintained to be higher than the temperature of the heat receiving main body. That is, a temperature difference between the outer surfaces of the heat receiving section and the ambient temperature can be small. Consequently, the temperature of the outer surfaces of the heat receiving section can be prevented from being lower than a dew point temperature of atmosphere surrounding the heat receiving section, and dew condensation on the outer surfaces of the heat receiving section can be prevented. Consequently, a water droplet is prevented from being formed on the outer surfaces of the heat receiving section. Even if the water droplet is formed, since the size of the water droplet is prevented from being increased, the water droplet is prevented from being dropped from the outer surfaces of the heat receiving section.

BRIEF DESCRIPTION OF THE DRAWINGS

Features and advantages of the present invention will become more apparent from the following detailed description when read in conjunction with the accompanying drawings, in which.

DESCRIPTION OF THE PREFERRED EMBODIMENT

Best Mode of Carrying Out the Invention

The best mode of carrying out the present invention is described with reference to the accompanying drawings.

[Embodiment]

Figure 1:
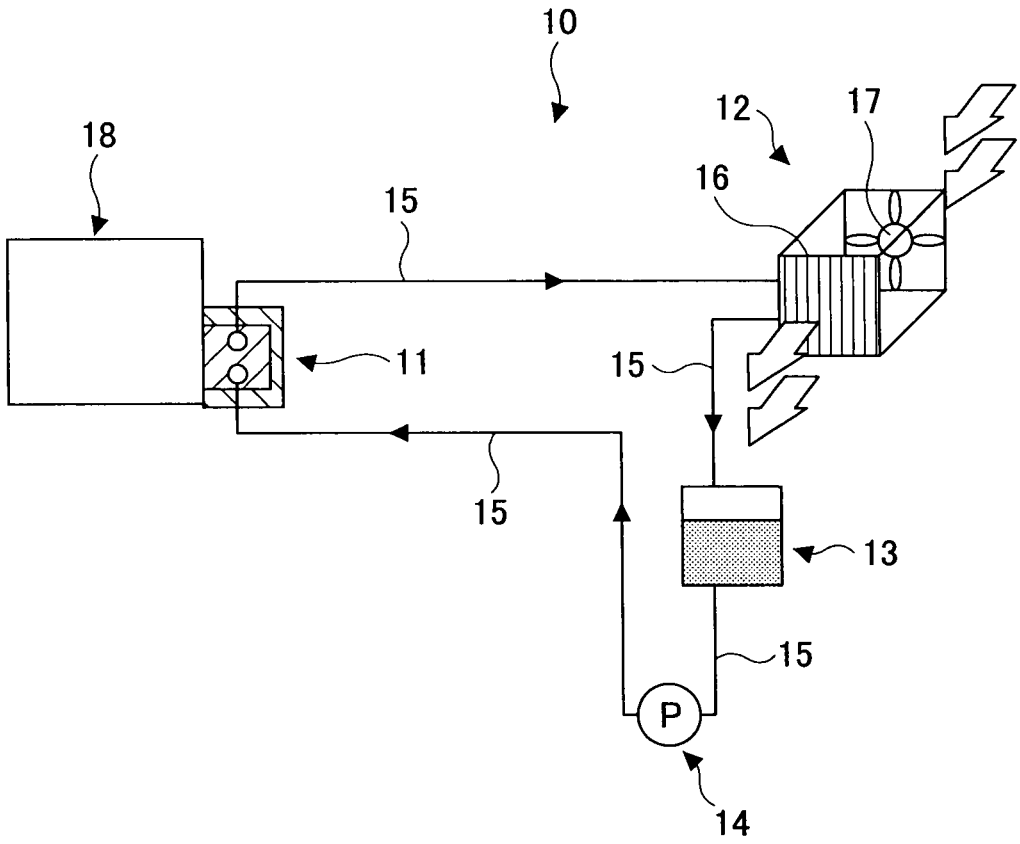
FIG. 1 is a schematic diagram showing a structure of a liquid-cooling type cooling device according to an embodiment of the present invention.
Figure 2:
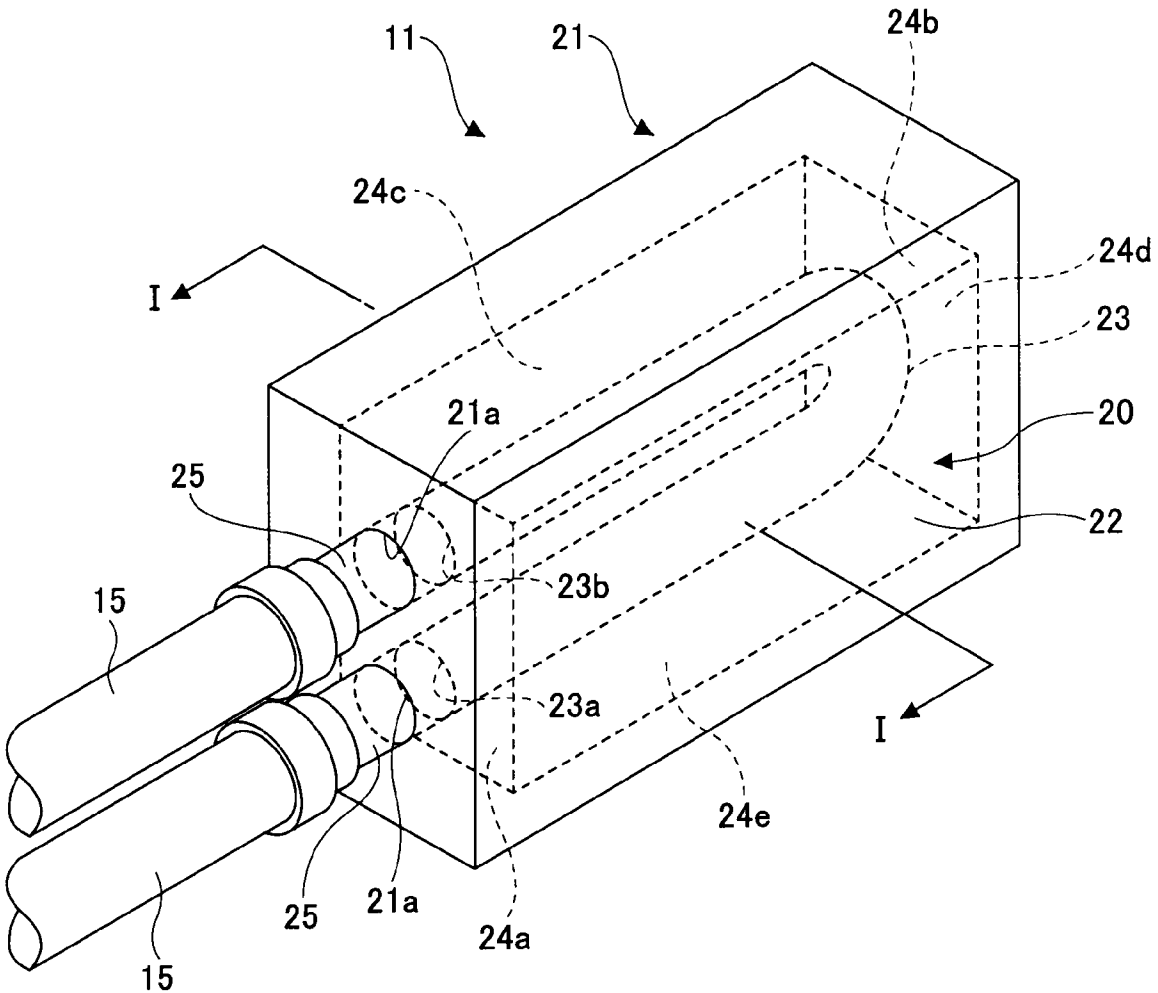
FIG. 2 is a perspective view of a structure of a heat receiving section of the liquid-cooling type cooling device shown in FIG. 1.
Figure 3:
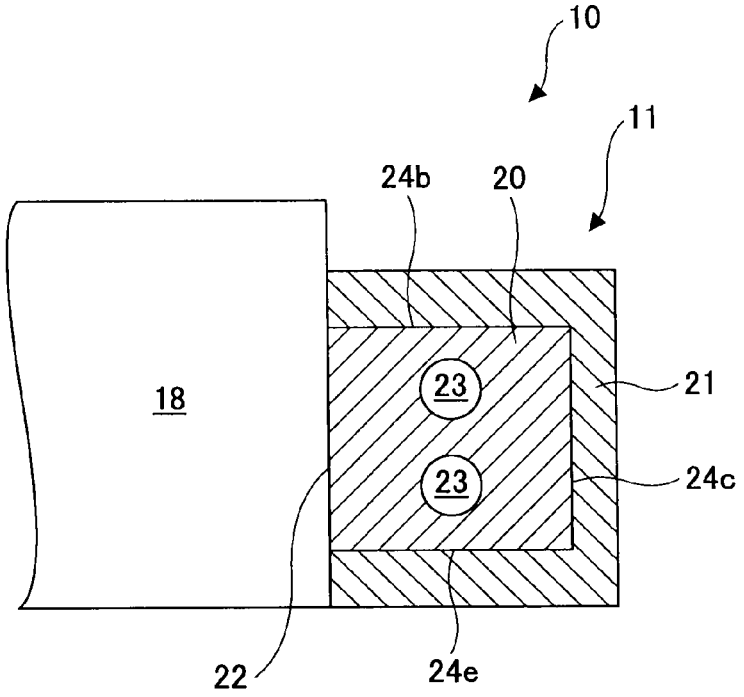
FIG. 3 is a cross-sectional view along line I-I of FIG. 2 when the heat receiving section contacts a temperature rising part of an image forming apparatus.

First, a structure of a liquid-cooling type cooling device 10 according to an embodiment of the present invention is described. FIG. 1 is a schematic diagram showing the structure of the liquid-cooling type cooling device 10 according to the embodiment of the present invention. FIG. 2 is a perspective view of a structure of a heat receiving section 11 of the liquid-cooling type cooling device 10 shown in FIG. 1. FIG. 3 is a cross-sectional view along line I-I of FIG. 2 when the heat receiving section 11 contacts a temperature rising part 18. In FIG. 1, a temperature rising part 18 of an image forming apparatus is also shown.

The liquid-cooling type cooling device 10 has a structure in which the heat receiving section 11, a radiator 12, a tank 13, and a pump (P) 14 are circularly connected by a circulating pipe 15 so that a circulating route of a liquid cooling medium is formed. As the liquid cooling medium, an antifreeze liquid is used in which the main component is propylene glycol and preservative is contained. The circulating pipe 15 is formed of metal such as copper and stainless steel.

The heat receiving section 11 causes the liquid cooling medium, which circulates heat of an object to be cooled, to absorb the heat. The structure of the heat receiving section 11 is described below in detail. The liquid cooling medium absorbs the heat by passing through the heat receiving section 11 and flows to the radiator 12 via the circulating pipe 15.

The radiator 12 includes a core part 16 having a water route whose heat releasing area is large (not shown) and a cooling fan 17 which blows air to the core part 16. In the radiator 12, the liquid cooling medium is cooled when the liquid cooling medium is passed through the core part 16; that is, heat is released from the liquid cooling medium. In other words, the radiator 12 functions as a heat releasing section in the liquid-cooling type cooling device 10. The liquid cooling medium passes through the radiator 12 and flows to the tank 13 via the circulating pipe 15.

The tank 13 temporarily stores the liquid cooling medium output from the radiator 12. The tank 13 prevents pressure from being largely changed in the circulating route. The liquid cooling medium passes through the tank 13 and flows to the pump 14 via the circulating pipe 15.

The pump 14 supplies the liquid cooling medium to the heat receiving section 11 via the circulating pipe 15. With this, in the liquid-cooling type cooling device 10, the liquid cooling medium is circulated in the circulating route, and the heat receiving section 11 causes the liquid cooling medium to absorb the heat and the radiator 12 causes the liquid cooling medium to release the heat. Therefore, the object to be cooled can be cooled.

Figure 7:
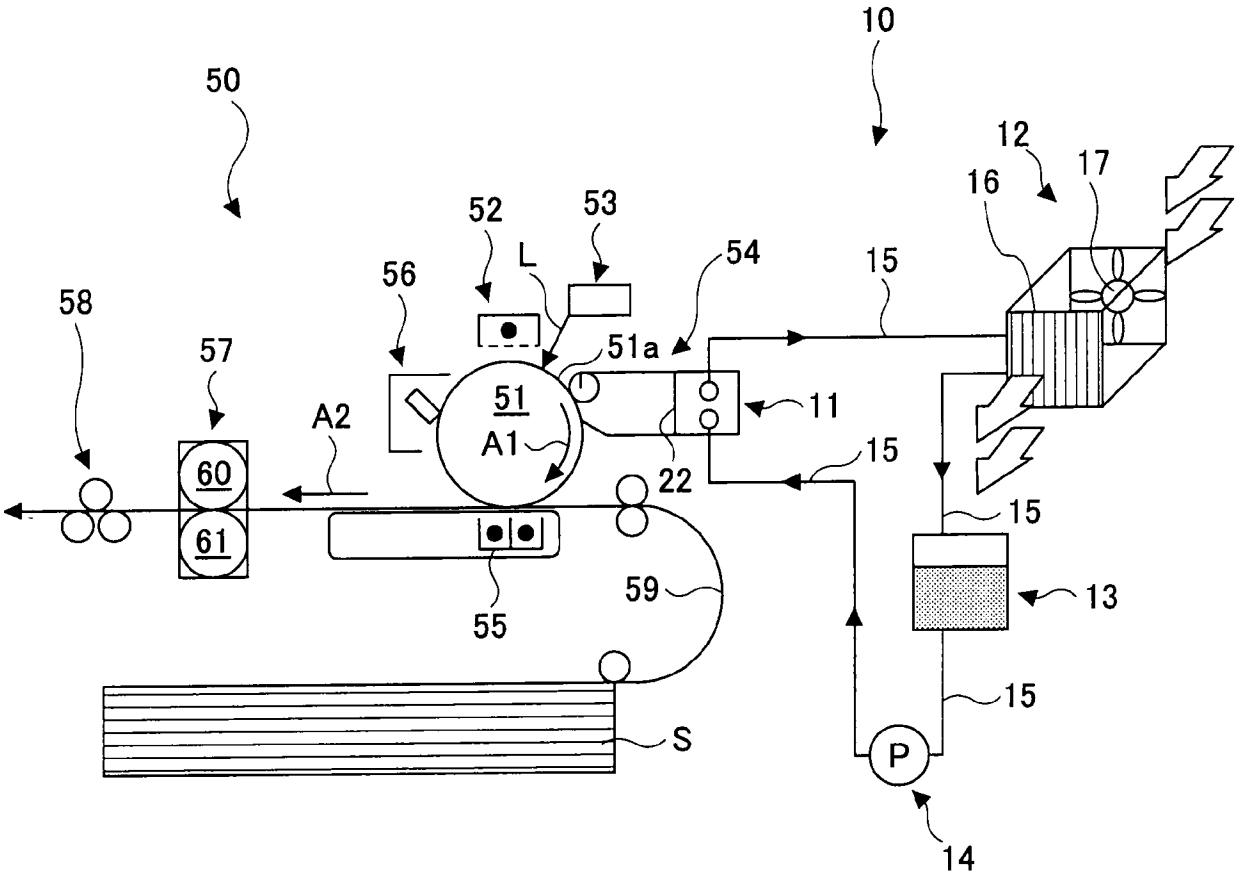
FIG. 7 is a schematic diagram showing an image forming apparatus using the liquid-cooling type cooling device shown in FIGS. 1 through 3.

The heat receiving section 11 contacts the object to be cooled. The object to be cooled is the temperature rising part 18 of an image forming apparatus 50 or 501 (see FIG. 7 or 8) described below. In FIG. 7, for example, the object to be cooled is, a reading device (not shown), a photoconductor drum 51, a developing device 54, toners (not shown), or a fixing unit 57.

As shown in FIGS. 2 and 3, the heat receiving section 11 which contacts the temperature rising part 18 includes a heat receiving main body 20 and a heat receiving main body covering part 21. The heat receiving main body 20 is formed of a high heat conductive material, for example, aluminum. The heat receiving main body 20 has a rectangular solid shape and one of the outer surfaces of the heat receiving main body 20 is a contacting surface 22 which contacts the temperature rising part 18.

The heat receiving main body 20 includes a flowing route 23. The flowing route 23 penetrates the heat receiving main body 20 to form one route so that one end 23*a* and the other end 23*b* of the flowing route 23 are adjacent to each other at one outer surface 24*a* of the heat receiving main body 20.

That is, in the flowing route 23, a part extending from the one end 23*a* and a part extending from the other end 23*b* are formed in parallel along the contacting surface 22 and the extended parts are connected by a U-shaped part.

The one end 23*a* is connected to one connecting route 25 and the other end 23*b* is connected to the other connecting route 25. The connecting route 25 connected to the one end 23*a* is connected to the circulating pipe 15 connected to the pump 14, and the connecting route 25 connected to the other end 23*b* is connected to the circulating pipe 15 connected to the radiator 12.

Therefore, the liquid cooling medium supplied to the heat receiving section 11 absorbs heat from the contacting surface 22 of the heat receiving main body 20 contacting the temperature rising part 18 when the liquid cooling medium passes through the flowing route 23, and the liquid cooling medium is supplied to the radiator 12.

In the above, the flowing route 23 extends along the contacting surface 22 and has the U-shaped part. However, when the flowing route 23 is formed by a structure in which the liquid cooling medium can efficiently absorb heat from an object to be cooled via the contacting surface 22 of the heat receiving section 11, the number of the flowing routes and the shape of the flowing route are not limited to the above. In addition, in the above, the flowing route 23 is connected to the circulating pipe 15 via the connecting routes 25. However, without using the connecting route 25, the flowing route 23 can be connected to the circulating pipe 15.

The heat receiving main body covering part 21 is formed to tightly cover outer surfaces 24*a*, 24*b*, 24*c*, 24*d*, and 24*e* of the heat receiving main body 20. That is, the heat receiving main body covering part 21 is not formed on the contacting surface 22 of the heat receiving main body 20. The heat receiving main body covering part 21 is formed of a material whose heat conductivity is lower than that of the heat receiving main body 20, and is formed of, for example, POM (polyoxymethylene: polyacetal). In addition, in the heat receiving main body covering part 21, two through holes 21*a* for passing through the two connecting routes 25 are formed in the outer surface 24*a* of the heat receiving main body 20.

As shown in FIG. 3, in the heat receiving section 11, the contacting surface 22 of the heat receiving main body 20 is disposed to contact the temperature rising part 18. The contacting surface 22 of the heat receiving main body 20 directly contacts the temperature rising part 18 in the present embodiment. However, when heat of the temperature rising part 18 is efficiently absorbed by the liquid cooling medium flowing in the flowing route 23 of the heat receiving main body 20, the structure is not limited to the above.

When an image forming apparatus using the liquid-cooling type cooling device 10 operates to form an image, the liquid-cooling type cooling device 10 operates the pump 14 based on a signal from a control device (not shown), and the liquid cooling medium is suctioned from the tank 13 to the pump 14 and is supplied to the flowing route 23 in the heat receiving section 11.

With this, heat generated from the temperature rising part 18 of the image forming apparatus is absorbed by the liquid cooling medium which flows in the flowing route 23 in the heat receiving section 11, and the temperature rising part 18 is cooled. The liquid cooling medium whose temperature has risen is supplied to the radiator 12 via the circulating pipe 15, and the heat is released by the radiator 12. The liquid cooling medium whose heat has been released by the radiator 12 returns the tank 13 via the circulating pipe 15. After this, the liquid cooling medium is circulated again in the circulating pipe 15, and cools the temperature rising part 18.

In the heat receiving section 11, the liquid cooling medium flowing in the flowing route 23 of the heat receiving main body 20 absorbs the heat of the temperature rising part 18 which contacts the contacting surface 22 of the heat receiving main body 20. The heat receiving main body 20 is formed of a high heat conductivity material, and the liquid cooling medium flowing in the flowing route 23 is sufficiently cooled by the radiator 12. Therefore, the heat receiving section 11 can absorb the heat of the temperature rising part 18 with high efficiency.

In addition, in the heat receiving section 11, the contacting surface 22 of the heat receiving main body 20 contacts the temperature rising part 18, and the outer surfaces 24*a*, 24*b*, 24*c*, 24*d*, and 24*e* of the heat receiving main body 20 other than the contacting surface 22 are covered with the heat receiving main body covering part 21. Therefore, the outer surfaces 24*a*, 24*b*, 24*c*, 24*d*, and 24*e* of the heat receiving main body 20 do not directly contact the outside. That is, the heat receiving main body 20 formed of the high heat conductivity material does not directly contact the ambient atmosphere. Therefore, even if the temperature of the heat receiving main body 20 falls by the liquid cooling medium flowing in the flowing route 23, dew is prevented from being condensed on the outer surfaces 24*a*, 24*b*, 24*c*, 24*d*, and 24*e* of the heat receiving main body 20.

In addition, in the heat receiving section 11, the outer surface, which contacts the surrounding ambient atmosphere, is covered with the heat receiving main body covering part 21 formed of a low heat conductivity material. Therefore, even if the temperature of the heat receiving main body 20 falls when the liquid cooling medium flows in the flowing route 23, the heat receiving main body covering part 21 covering the heat receiving main body 20 prevents the temperature of the heat receiving section 11 from being lowered. Consequently, a temperature difference between the outer surface of the heat receiving main body covering part 21 (the outer surface of the heat receiving section 11) and the surrounding ambient temperature can be small.

With this, the temperature of the outer surface of the heat receiving section 11 can be prevented from being lower than the dew point temperature of the atmosphere at the position disposed the heat receiving section 11, and dew is prevented from being condensed on the outer surface of the heat receiving section 11. That is, water droplets are prevented from being formed on the outer surface of the heat receiving section 11 and are prevented from being dropped from the outer surface of the heat receiving section 11.

Therefore, even if the liquid-cooling type cooling device 10 is installed in the image forming apparatus 50 or 501 (see FIG. 7 or 8) whose internal humidity is likely to become high, the water droplets can be prevented from being dropped from the heat receiving section 11. Consequently, the degradation of the image quality due to blurring of the image and the stain of the paper caused by the dropping of the water droplets from the heat receiving section 11 can be prevented. In addition, since the temperature rising part 18 of the image forming apparatus can be suitably cooled, the image forming apparatus can be suitably operated.

The liquid-cooling type cooling device 10 can be suitably used in an image forming apparatus, for example, in a so-called high-speed apparatus, which is continuously operated for several days for printing a large number of documents in a printing office.

That is, since the high-seed apparatus is continuously operated for a long time, the liquid-cooling type cooling device 10 is also continuously operated for a long time for cooling the temperature rising part 18 of the high-speed apparatus. In the heat receiving section 11, the liquid cooling medium is continuously supplied to the heat receiving section 11 during the operation of the high-speed apparatus so that the heat at the temperature rising part 18 of the high-speed apparatus is absorbed, and the temperature of the heat receiving section 11 is maintained to be a low temperature. In a case where dew is condensed, when the continuous operating time is long, the size of the water droplet is likely to become large.

In a conventional liquid-cooling type cooling device in which the size of the water droplets formed by the dew condensation at the heat receiving section is prevented from being large, when the continuous operating time becomes large in the high-speed apparatus, the amount of the water droplets formed at the outer surface of the heat receiving section is increased; consequently, there is a risk that dropping of the water droplets is generated. However, in the liquid-cooling type cooling device 10 according to the present embodiment, since the dew condensation itself is prevented at the heat receiving section 11, regardless of the length of the continuous operating time, the water droplets can be prevented from being dropped.

Modified Example 1

Figure 4:
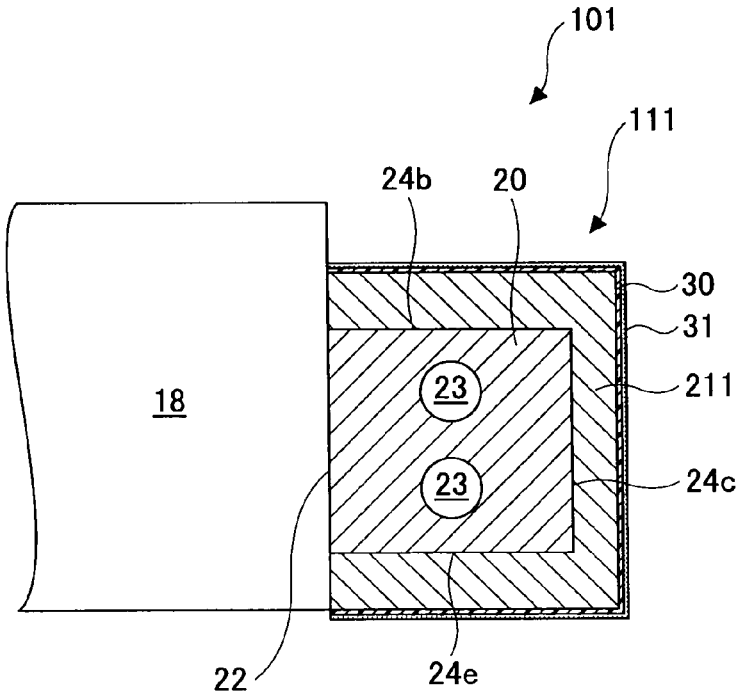
FIG. 4 is a schematic diagram showing a liquid-cooling type cooling device in a modified example 1.

Next, a liquid-cooling type cooling device 101 of a modified example 1 according to the embodiment of the present invention is described. The basic structure of the liquid-cooling type cooling device 101 is the same as that of the liquid-cooling type cooling device 10. Therefore, in the modified example 1 shown in FIG. 4, when an element is similar to or the same as that of the liquid-cooling type cooling device 10 shown in FIGS. 1 through 3, the same reference number as that shown in FIGS. 1 through 3 is used, and the same description as that shown in FIGS. 1 through 3 is omitted. FIG. 4 is a schematic diagram showing the liquid-cooling type cooling device 101.

As shown in FIG. 4, in the liquid-cooling type cooling device 101, a high hydrophilic layer 30 to which a high hydrophilic material is applied is formed on outer surfaces of a heat receiving main body covering part 211 which covers the outer surfaces of the heat receiving main body 20 other than the contacting surface 22. The high hydrophilic layer 30 can be formed by applying a surface-active agent, a silica-glass coating agent, and the like onto the heat receiving main body covering part 211. That is, the high hydrophilic layer 30 is formed at parts corresponding to the outer surfaces of the heat receiving section 111 other than the contacting surface 22.

In the liquid-cooling type cooling device 101, similar to in the liquid-cooling type cooling device 10, since dew is prevented from being condensed on the outer surfaces of the heat receiving section 111, even if the dew is condensed, the size of water droplets is prevented from being large, and the water droplets are prevented from being dropped from the heat receiving section 111.

In addition, in the liquid-cooling type cooling device 101, when the humidity in the image forming apparatus 50 or 501 (see FIG. 7 or FIG. 8) having the liquid-cooling type cooling device 101 becomes remarkably high, the dew point temperature in atmosphere of a position at the heat receiving section 111 becomes high, and dew is condensed on the outer surfaces of the heat receiving section 111; however, since the outer surfaces of the heat receiving section 111 are covered with the high hydrophilic layer 30, water formed by the dew condensation does not become water droplets, but becomes a water film 31 which thinly covers the outer surfaces of the heat receiving section 111.

Since the water film 31 is formed on the high hydrophilic layer 30 of the heat receiving main body covering part 211 on which the dew is prevented from being condensed, the water film 31 is remarkably thin and is evaporated before the water becomes a water droplet to be dropped. Consequently, a large water droplet is prevented from being formed on the outer surfaces of the heat receiving section 111, and dropping of the water droplets is surely prevented.

As described above, in the liquid-cooling type cooling device 101, even if the liquid-cooling type cooling device 101 is installed in an image forming apparatus whose inter humidity is likely to become high, dropping of the water droplets can be surely prevented from the heat receiving section 111.

In the modified example 1, the high hydrophilic layer 30 is formed on the outer surfaces of the heat receiving main body covering part 211 by applying a high hydrophilic material. However, it is sufficient when parts corresponding to the outer surfaces of the heat receiving section 111 are formed of a high hydrophilic material. That is, the embodiment is not limited to the modified example 1.

Modified Example 2

Figure 5:
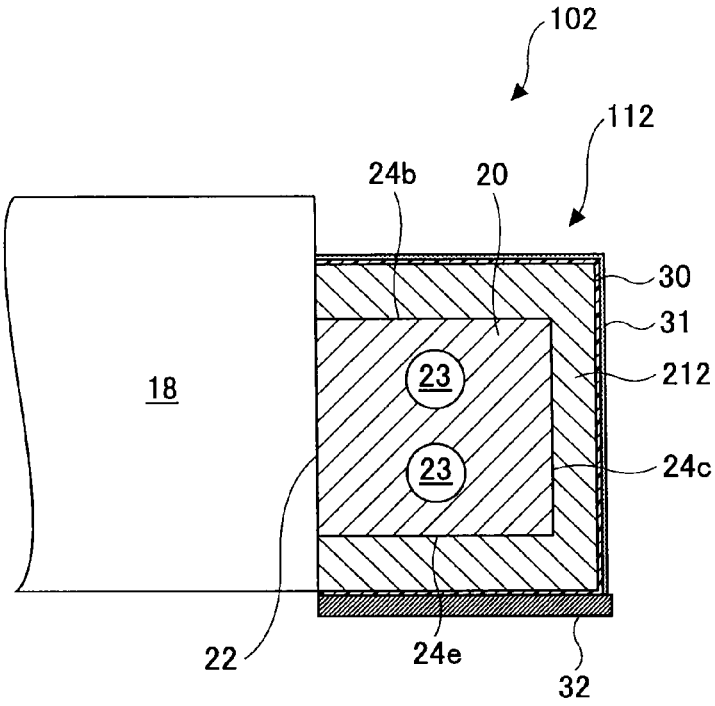
FIG. 5 is a schematic diagram showing a liquid-cooling type cooling device in a modified example 2.

Next, a liquid-cooling type cooling device 102 of a modified example 2 according to the embodiment of the present invention is described. The basic structure of the liquid-cooling type cooling device 102 is the same as that of the liquid-cooling type cooling device 101 in the modified example 1. Therefore, in the modified example 2 shown in FIG. 5, when an element is similar to or the same as that of the liquid-cooling type cooling device 101 shown in FIG. 4, the same reference number as that shown in FIG. 4 is used, and the same description as that shown in FIG. 4 is omitted. FIG. 5 is a schematic diagram showing the liquid-cooling type cooling device 102.

As shown in FIG. 5, in the liquid-cooling type cooling device 102, the high hydrophilic layer 30 is formed on outer surfaces of a heat receiving main body covering part 212 which covers the outer surfaces of the heat receiving main body 20 other than the contacting surface 22. In addition to the high hydrophilic layer 30, a heat receiving section 112 provides a moisture absorbing part 32.

The moisture absorbing part 32 is formed of a high hygroscopic material, and the material is a ceramic material whose base is a diatom earth. The moisture absorbing part 32 has a plate shape and is stuck on an outer surface of a heat receiving section 112 at the side of the outer surface **24*e* (see FIG. 2) of the heat receiving main body 20. The outer surface 24*e*** is positioned in the gravitational force direction.

Similar to the liquid-cooling type cooling device 10, since the liquid-cooling type cooling device 102 prevents dew from being condensed on the outer surfaces of the heat receiving section 112 and prevents the size of water droplets from being large, the water droplets are prevented from being dropped from the heat receiving section 112.

In addition, similar to the liquid-cooling type cooling device 101 shown in FIG. 4, even if dew is condensed on the outer surfaces of the heat receiving section 112, since the dew becomes the water film 31 without forming water droplets, the water droplets is surely prevented from being dropped from the heat receiving section 112.

In addition, even if the dew is condensed on the outer surfaces of the heat receiving section 112 of the liquid-cooling type cooling device 102, the water droplets formed by the dew are absorbed by the moisture absorbing part 32. Therefore, large water droplets are surely prevented from being formed on the outer surfaces of the heat receiving section 112 and the water droplets are prevented from being dropped from the heat receiving section 112.

Therefore, even if the liquid-cooling type cooling device 102 is installed in the image forming apparatus 50 or 501 (see FIG. 7 or 8) whose internal humidity is likely to become high, the water droplets can be surely prevented from being dropped from the heat receiving section 112.

In the modified example 2, the moisture absorbing part 32 having the plate shape is disposed on the outer surface of the heat receiving section 112 at the downside. However, it is sufficient when a high hygroscopic member is provided at least at a part of the outer surfaces of the heat receiving main body covering part 212. That is, the embodiment is not limited to the modified example 2.

In addition, in the modified example 2, the moisture absorbing part 32 is provided in the heat receiving main body covering part 212 having the high hydrophilic layer 30. However, the high hydrophilic layer 30 is not always required. That is, the embodiment is not limited to the modified example 2.

Modified Example 3

Figure 6:
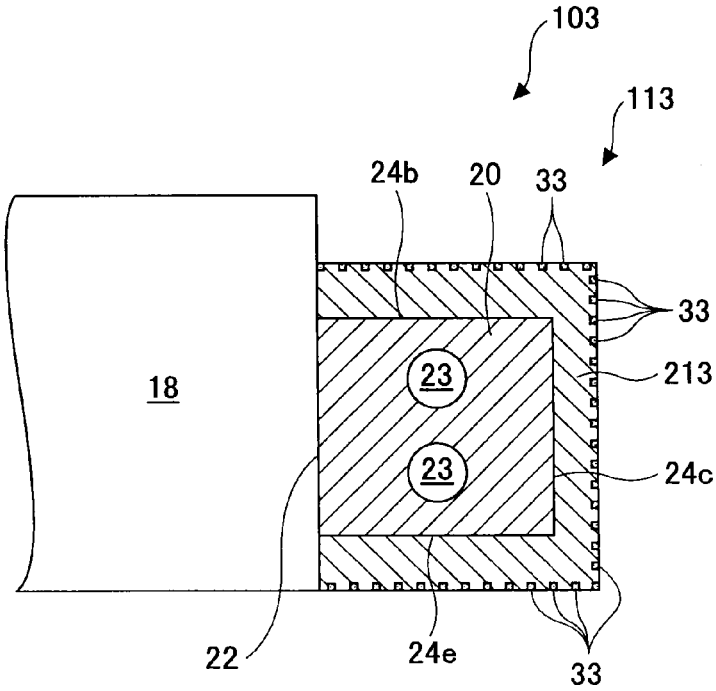
FIG. 6 is a schematic diagram showing a liquid-cooling type cooling device in a modified example 3.

Next, a liquid-cooling type cooling device 103 of a modified example 3 according to the embodiment of the present invention is described. The basic structure of the liquid-cooling type cooling device 103 is the same as that of the liquid-cooling type cooling device 10 shown in FIGS. 1 through 3 in the embodiment of the present invention. Therefore, in the modified example 3 shown in FIG. 6, when an element is similar to or the same as that of the liquid-cooling type cooling device 10 shown in FIGS. 1 through 3, the same reference number as that shown in FIGS. 1 through 3 is used, and the same description as that shown in FIGS. 1 through 3 is omitted. FIG. 6 is a schematic diagram showing the liquid-cooling type cooling device 103.

As shown in FIG. 6, in the liquid-cooling type cooling device 103, plural grooves 33 are formed in outer surfaces of a heat receiving main body covering part 213 which covers the outer surfaces of the heat receiving main body 20 other than the contacting surface 22 in a heat receiving section 113. The depth and the width of the groove 33 is suitably determined so that the groove 33 suitably stores water formed by dew condensation on the outer surfaces of the heat receiving main body covering part 213 in the heat receiving section 113. The water is stored in the groove 33 by a capillary phenomenon. In order to suitably store the water in the groove 33, the groove 33 is preferably formed to extend in the vertical direction when the heat receiving section 113 is installed in an image forming apparatus.

Similar to the liquid-cooling type cooling device 10 shown in FIGS. 1 through 3, since the liquid-cooling type cooling device 103 prevents dew from being condensed on the outer surfaces of the heat receiving section 113 and prevents the size of water droplets from being large, the water droplets are prevented from being dropped from the heat receiving section 113.

In addition, in the liquid-cooling type cooling device 103, when the humidity in the image forming apparatus 50 or 501 (see FIG. 7 or FIG. 8) having the liquid-cooling type cooling device 103 becomes remarkably high, the dew point temperature in atmosphere of a position at the heat receiving section 113 becomes high, and dew is condensed on the outer surfaces of the heat receiving section 113; however, since the grooves 33 are formed in the outer surfaces of the heat receiving main body covering part 213 in the heat receiving section 113, water formed by the dew condensation is stored in the grooves 33 without being formed to be water droplets. Therefore, large water droplets can be prevented from being formed on the outer surfaces of the heat receiving section 113, and the water droplets can be surely prevented from being dropped from the heat receiving section 113.

Therefore, even if the liquid-cooling type cooling device 103 of the modified example 3 is installed in an image forming apparatus whose internal humidity is likely to become high, the water droplets can be surely prevented from being dropped from the heat receiving section 113.

In the modified example 3, the plural grooves 33 are formed in the heat receiving main body covering part 213. However, the grooves 33 can be formed in the high hydrophilic layer 30 of the heat receiving main body covering part 211 in the modified example 1. In addition, the grooves 33 can be formed in the high hydrophilic layer 30 of the heat receiving main body covering part 212 in the modified example 2. That is, the embodiment of the present invention is not limited to the modified example 3.

Specific Example 1

Next, a specific example 1 of an image forming apparatus in which the liquid-cooling type cooling device 10 is installed is described. In the specific example 1, instead of installing the liquid-cooling type cooling device 10, the liquid-cooling type cooling device 101, 102, or 103 can be installed in the image forming apparatus.

In the specific example 1, operations of the image forming apparatus have been studied. As the image forming apparatus, a monochrome image forming apparatus whose model name is Imagio Neo 750 (a product of Ricoh) is used. FIG. 7 is a schematic diagram showing the image forming apparatus 50 using the liquid-cooling type cooling device 10 in the specific example 1.

As shown in FIG. 7, the image forming apparatus 50 includes the photoconductor drum 51, a charging device 52, a writing device 53, the developing device 54, a transferring device 55, a cleaning device 56, the fixing unit 57, and a decurler 58.

The photoconductor drum 51 has a cylindrical shape and an electrostatic latent image is formed on the photoconductor drum 51. The photoconductor drum 51 rotates in the arrow direction A1 with a shaft extending in the direction perpendicular to the plane of the paper in FIG. 7 as the center by receiving a driving force from a driving mechanism (not shown). The charging device 52 is disposed at a position facing the photoconductor drum 51.

The charging device 52 uniformly charges an outer surface 51*a* of the photoconductor drum 51 facing the charging device 52 with desirable potential by receiving electric power from a power supply device (not shown). At this time, since the photoconductor drum 51 rotates in the arrow direction A1, a part of the outer surface 51*a* at the downstream side from the position facing the charging device 52 is uniformly charged sequentially corresponding to the rotation of the photoconductor drum 51.

Next, laser beams L (or light having image information of a document such as light reflected from or transmitted through the document) are radiated from the writing device 53 onto the outer surface 51*a* uniformly charged by the charging device 52. The amount of the laser beams L is controlled based on the image information of characters and figures read from the document or image information stored beforehand.

At this time, the electric potential (negative potential) of the outer surface 51*a* of the photoconductor drum 51 is lowered (the absolute potential rises to become near zero) by the radiation of the laser beams L. The amount of the lowering potential becomes large when the radiating amount of the laser beams L becomes large. By the radiation of the laser beams L having the image information, an electrostatic latent image having an electric potential distribution corresponding to the image information is formed on the outer surface 51*a* of the photoconductor drum 51.

The developing device 54 adheres toners to the electrostatic latent image on the outer surface 51*a* of the photoconductor drum 51. That is, when the outer surface 51*a* of the photoconductor drum 51 on which the electrostatic latent image has been formed passes through the developing device 54, an amount of toners corresponding to the electric potential distribution of the electrostatic latent image is adhered onto the outer surface 51*a* of the photoconductor drum 51, and a toner image having a density distribution corresponding to the electrostatic latent image is visualized (developed) on the outer surface 51*a* of the photoconductor drum 51.

The transferring device 55 transfers the toner image onto a sheet (paper) S. That is, when the sheet S is transported toward the photoconductor drum 51 by a sheet transporting path 59 with predetermined timing and is passed through a position between the photoconductor drum 51 and the transferring device 55, the toner image is transferred onto the sheet S by being tightly pressed. The sheet S onto which the toner image has been transferred is transported toward the fixing unit 57 in the arrow direction A2.

The fixing unit 57 includes a heat applying fixing roller 60 and a pressure applying roller 61. When the sheet S is transported to the fixing unit 57, and is passed through a position between the heat applying fixing roller 60 and the pressure applying roller 61; the toners adhered onto the sheet S are pressed on the sheet S by being sandwiched between the heat applying fixing roller 60 and the pressure applying roller 61 while being softened by heat of the heat applying fixing roller 60. With this, the toner image is fixed on the sheet S. When the toner image fixed by the fixing unit 57 is passed through the decurler 58, a curl formed on the sheet S by the fixing unit 57 and so on is corrected and the sheet S is cooled.

The cleaning device 56 cleans the outer surface 51*a* of the photoconductor drum 51 after transferring the toner image onto the sheet S. That is, after transferring the toner image onto the sheet S, the unused toners remain on the outer surface 51*a* of the photoconductor drum 51, and the cleaning device 56 cleans the outer surface 51*a* of the photoconductor drum 51 by removing the remaining toners from the outer surface 51*a* of the photoconductor drum 51. In addition, a quenching lamp (not shown) removes remaining charges on the outer surface 51*a* of the photoconductor drum 51. Then the image forming apparatus 50 enters a subsequent charging process waiting state.

In the specific example 1, the liquid-cooling type cooling device 10 is used to cool the developing device 54. That is, in the specific example 1, the temperature rising part 18 of the image forming apparatus 50 is determined to be the developing device 54. In the developing device 54, friction heat is generated in toners by being stirred so that the toners obtain chargeability, and radiation heat is applied to the toners from the fixing unit 57 and so on. Consequently, the temperature of the toners rises.

Generally, when the temperature of the toners rises near the softening point temperature, the toners are fused, solidified, or transformed, and defective developing is caused. In order to avoid the above, the developing device 54 is cooled so that the internal temperature of the developing device 54 is always less than a target temperature determined by the softening point temperature of the toners. In the image forming apparatus 50 of the specific example 1, the target temperature is determined to be less than 50° C.

The liquid-cooling type cooling device 10 is installed in the image forming apparatus 50 so that the contacting surface 22 of the heat receiving section 11 contacts the developing device 54. The other elements of the liquid-cooling type cooling device 10 are disposed at positions separated from electric circuits to be insulated, high-voltage sections, and a paper feeding tray (not shown) in the image forming apparatus 50 as much as possible. The high-voltage sections are the photoconductor drum 51, the charging device 52, the writing device 53, the developing device 54, the transferring device 55, the fixing unit 57, a control device (not shown), and a power supplying device (not shown).

In addition, the radiator 12 of the liquid-cooling type cooling device 10 is disposed so that wind blown from the cooling fan 17 and passed through the core part 16 is output to the outside of the image forming apparatus 50 (the outside of a cabinet (not shown) of the image forming apparatus 50). The liquid-cooling type cooling device 10 can be operated corresponding to an image forming operation of the image forming apparatus 50, or can be operated corresponding the temperature of the temperature rising part 18 (the developing device 54 in the specific example 1).

In the specific example 1, a first experiment was performed. In the first experiment, in the image forming apparatus 50 (Imagio Neo 750), double-sided printing was continuously performed for three hours at a speed of 75 sheets per one minute.

In the first experiment, the internal temperature of the developing device 54 was measured. In the results of the first experiment, the maximum internal temperature was 47° C. which was lower than the target temperature 50° C. determined based on the used toners. In addition, the toners in the developing device 54 were not found to be defective.

In the first experiment, water detecting sensors (not shown) were disposed at positions surrounding the heat receiving section 11 of the liquid-cooling type cooling device 10 in the image forming apparatus 50. The water detecting sensors did not detect water. Further, by also a visual confirmation, dropping of water droplets was not found at the positions surrounding the heat receiving section 11 and a water droplet was not formed on the outer surfaces of the heat receiving section 11.

In addition, in the first experiment, when plural sheets S randomly selected from a large number of the sheets S onto which the double-sided printing was applied were inspected, a defective image such as a blurring image was not detected from a viewpoint of the image quality and the plural sheets S were not stained.

In the specific example 1, the liquid-cooling type cooling device 10 is applied to the developing device 54 in the image forming apparatus 50 as the temperature rising part 18. However, the liquid-cooling type cooling device 10 can be applied to other elements in the image forming apparatus 50 as the temperature rising part 18.

Specific Example 2

Next, a specific example 2 of an image forming apparatus in which a liquid-cooling type cooling device 10' is installed is described. The liquid-cooling type cooling device 10' is described below. The liquid-cooling type cooling device 10' is a device modified from the liquid-cooling type cooling device 10.

In the specific example 2, instead of installing the liquid-cooling type cooling device 10', a liquid-cooling type cooling device 101', 102', or 103' modified from the liquid-cooling type cooling device 101, 102, or 103 can be installed in the image forming apparatus.

Figure 8:
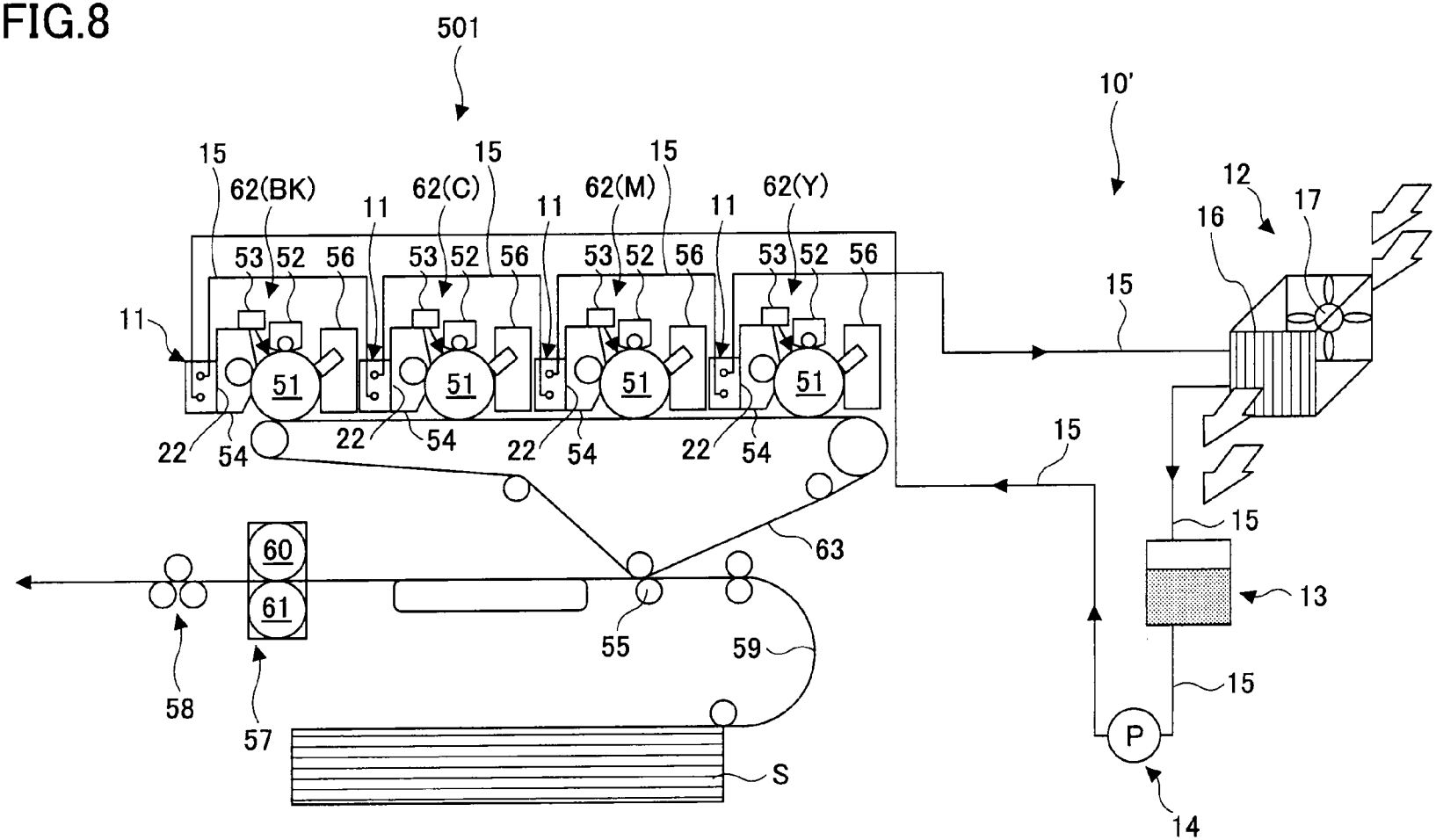
FIG. 8 is a schematic diagram showing another image forming apparatus using a liquid-cooling type cooling device modified from the liquid-cooling type cooling device shown in FIGS. 1 through 3.

In the specific example 2, operations of the image forming apparatus have been studied. As the image forming apparatus, a four-image forming device connecting tandem type image forming apparatus whose model name is Imagio Neo C600 (a product of Ricoh) is used. FIG. 8 is a schematic diagram showing an image forming apparatus 501 using the liquid-cooling type cooling device 10' in the specific example 2.

As shown in FIG. 8, the image forming apparatus 501 includes four image forming devices 62(BK) for black, 62(C) for cyan, 62(M) for magenta, and 62(Y) for yellow; an intermediate transfer belt 63, the transferring device 55, the fixing unit 57, and the decurler 58. The transferring device 55, the fixing unit 57, and the decurler 58 are the same as those in the image forming apparatus 50 shown in FIG. 7. Therefore, the same description is omitted.

In the following, the image forming devices 62 represents the four image forming devices 62(BK) for black, 62(C) for cyan, 62(M) for magenta, and 62(Y) for yellow.

Similar to the image forming apparatus 50 shown in FIG. 7, in each of the four image forming devices 62, the photoconductor drum 51, the charging device 52, the writing device 53, the developing device 54, and the cleaning device 56 are provided. In each of the four image forming devices 62, an electrostatic latent image is formed on the photoconductor drum 51, and a toner image is formed on the photoconductor drum 51. The toner images formed on the corresponding photoconductor drums 51 are transferred onto the intermediate transfer belt 63 (image carrier).

The toner images transferred onto the intermediate transfer belt 63 are transferred onto a sheet S transported by the sheet transporting path 59 by the transferring devices 55. The toner images transferred onto the sheet S are fixed on the sheet S by the fixing unit 57. With this, a color image is formed on the sheet S.

In the specific example 2, the liquid-cooling type cooling device 10' is used to cool the developing device 54 in each of the image forming devices 62. That is, in the specific example 2, the temperature rising parts 18 of the image forming apparatus 501 are determined to be the developing devices 54 of the image forming devices 62. In the image forming apparatus 501 of the specific example 2, the target temperature of the internal temperature of the developing device 54 is determined to be less than 45° C. from a viewpoint of the softening point temperature of the used toners.

In the liquid-cooling type cooling device 10', in order to cool the four developing devices 54 in the image forming devices 62, the four heat receiving sections 11 are connected in series by the circulating pipe 15. The contacting surface 22 of the heat receiving section 11 contacts the developing device 54 in each of the four image forming devices 62 in the image forming apparatus 501.

In the heat receiving section 11 of the specific example 2, the heat receiving main body 20 is formed of copper and the heat receiving main body covering part 21 is formed of polyacetal.

In addition, as the liquid cooling medium, an aqueous solution is used in which a mixture of ethylene glycol and propylene glycol is the main component and preservative is contained in the mixture.

In the specific example 2, a second experiment was performed. In the second experiment, in the image forming apparatus 501 (Imagio Neo C600), color double-sided printing was continuously performed for four hours at a speed of 45 sheets per one minute.

In the second experiment, the internal temperature of the developing device 54 in each of the image forming devices 62 was measured. In the results of the second experiment, the maximum internal temperature was 42 to 44° C. which was lower than the target temperature 45° C. determined based on the used toners. In addition, the toners in the developing devices 54 were not found to be defective.

In the second experiment, water detecting sensors (not shown) were disposed at positions surrounding each of the heat receiving sections 11 of the liquid-cooling type cooling device 10' in the image forming apparatus 501. The water detecting sensors did not detect water. Further, by also a visual confirmation, dropping of water droplets was not found at the positions surrounding each of the heat receiving sections 11 and a water droplet was not formed on the outer surfaces of each of the heat receiving section 11.

In addition, in the second experiment, when plural sheets S randomly selected from a large number of the sheets S onto which the color double-sided printing was applied were inspected, a defective image such as a blurry image was not detected from a viewpoint of the image quality and the plural sheets S were not stained.

In the specific example 2, the liquid-cooling type cooling device 10' is applied to the developing device 54 in the image forming apparatus 501 as the temperature rising part 18. However, the liquid-cooling type cooling device 10' can be applied to other elements in the image forming apparatus 501 as the temperature rising part 18.

In the embodiment of the present invention, the liquid-cooling type cooling device 10 (10') is applied to the image forming apparatus 50 (501) of the electrophotographic system. However, the present embodiment can be applied to an image forming apparatus which has a unit or a member whose temperature rises when the apparatus is operated. That is, the present embodiment can be applied to, for example, an image forming apparatus of an inkjet system.

In addition, in the embodiment of the present invention, the shape of the heat receiving section 11 is rectangular and the contacting surface 22 is a flat surface. However, when the liquid-cooling type cooling device 10 (10') can cool the temperature rising part 18 of the image forming apparatus 50 (501), the shape of the heat receiving section 11 is not limited to rectangular and the contacting surface 22 is not limited to the flat surface.

Further, the present invention is not limited to the specifically disclosed embodiment, and variations and modifications may be made without departing from the scope of the present invention.

The present invention is based on Japanese Priority Patent Application No. 2008-180078, filed on Jul. 10, 2008, with the Japanese Patent Office, the entire contents of which are hereby incorporated herein by reference.

What is claimed is:

1. A liquid-cooling type cooling device which cools a temperature rising part of an image forming apparatus by forming a circulating route of a liquid cooling medium, comprising:

a heat receiving section which causes the liquid cooling medium to absorb heat of the temperature rising part;

a radiator which causes the heat of the liquid cooling medium to release; and a pump which circulates the liquid cooling medium, wherein the heat receiving section includes a heat receiving main body including a flowing route of the liquid cooling medium, a contacting surface for contacting the temperature rising part, and a heat receiving main body covering part which covers outer surfaces other than the contacting surface of the heat receiving main body; and the heat receiving main body covering part includes a material whose heat conductivity is lower than the heat conductivity of the heat receiving main body, wherein the flowing route penetrates the heat receiving main body that has a solid body other than the flowing route, the solid body encircles and contacts the flowing route, and the flowing route within the heat receiving main body is a continuous uniform flow route.

2. The liquid-cooling type cooling device as claimed in claim 1, wherein:

the heat receiving main body covering part is formed of a resin.

3. The liquid-cooling type cooling device as claimed in claim 1, wherein:

outer surfaces of the heat receiving main body covering part are formed of a material whose hydrophilic property is high.

4. The liquid-cooling type cooling device as claimed claim 1, wherein:

at least a part of outer surfaces of the heat receiving main body covering part is formed of a material whose moisture absorbing property is high.

5. The liquid-cooling type cooling device as claimed in claim 1, wherein:

a groove capable of storing a water droplet is formed in at least a part of outer surfaces of the heat receiving main body covering part.

6. An image forming apparatus, comprising:

the liquid-cooling type cooling device as claimed in claim 1.

7. The liquid-cooling type cooling device as claimed in claim 1, wherein:

the flowing route includes one route so that one end and another end of the flowing route are adjacent to each other at one outer surface of the solid body of the heat receiving main body, the flowing route including a U-shaped part, the flowing route entering and exiting a same side surface of the solid body.

8. A liquid-cooling type cooling device which cools a temperature rising part of an image forming apparatus by forming a circulating route of a liquid cooling medium, comprising:

a heat receiving section which causes the liquid cooling medium to absorb heat of the temperature rising part;

a radiator which causes the heat of the liquid cooling medium to release; and a pump which circulates the liquid cooling medium, wherein the heat receiving section includes a heat receiving main body including a flowing route of the liquid cooling medium, a contacting surface for contacting the temperature rising part, and a heat receiving main body covering part which covers outer surfaces other than the contacting surface of the heat receiving main body; and the heat receiving main body covering part includes a material whose heat conductivity is lower than the heat conductivity of the heat receiving main body, wherein the flowing route penetrates the heat receiving main body, the heat receiving main body encircles and contacts the flowing route, and the flowing route includes a U-shaped part within the heat receiving main body and enters and exits a same side surface of the heat receiving main body.

9. A liquid-cooling type cooling device which cools a temperature rising part of an image forming apparatus by forming a circulating route of a liquid cooling medium, comprising:

a heat receiving section which causes the liquid cooling medium to absorb heat of the temperature rising part;

a radiator which causes the heat of the liquid cooling medium to release; and a pump which circulates the liquid cooling medium, wherein the heat receiving section includes a heat receiving main body including a flowing route of the liquid cooling medium, a contacting surface for contacting the temperature rising part, and a heat receiving main body covering part which covers outer surfaces other than the contacting surface of the heat receiving main body; and the heat receiving main body covering part includes a material whose heat conductivity is lower than the heat conductivity of the heat receiving main body, wherein the flowing route penetrates the heat receiving main body, the heat receiving main body encircles and contacts the flowing route, and the flowing route includes a U-shaped part enclosed in the main body.

* * * * *